US006289860B1

(12) United States Patent
Speckhart et al.

(10) Patent No.: US 6,289,860 B1
(45) Date of Patent: Sep. 18, 2001

(54) ASSEMBLY FOR ALTERING CAMSHAFT TIMING

(76) Inventors: Frank H. Speckhart, 3411 Kingston Pike, Knoxville, TN (US) 37919; John C. McCracken, 7505 Riverlake Ct. #17, Knoxville, TN (US) 37920

( * ) Notice: Subject to any disclaimer, the term of this patent is extended or adjusted under 35 U.S.C. 154(b) by 0 days.

(21) Appl. No.: 09/477,250

(22) Filed: Jan. 4, 2000

(51) Int. Cl.[7] ..... F01L 1/34

(52) U.S. Cl. ..... 123/90.15; 123/90.16; 123/90.17; 123/90.31; 74/568 R; 464/1; 464/2; 464/160

(58) Field of Search ..... 123/90.17, 90.31; 74/568 R; 464/1, 2, 160

(56) References Cited

U.S. PATENT DOCUMENTS

| | | | | |
|---|---|---|---|---|
| 1,202,463 | * | 10/1916 | Wilkinson | 464/3 |
| 1,388,743 | * | 8/1921 | Moore | 464/3 |
| 3,262,435 | | 7/1966 | Cribbs . | |
| 3,455,286 | | 7/1969 | Reisacher et al. . | |
| 4,577,592 | * | 3/1986 | Bosch et al. | 123/90.15 |
| 4,955,330 | | 9/1990 | Fabi et al. . | |
| 5,181,486 | | 1/1993 | Gyurovits . | |
| 5,609,127 | | 3/1997 | Noplis . | |

* cited by examiner

*Primary Examiner*—Thomas Denion
*Assistant Examiner*—Jaime Corrigan
(74) *Attorney, Agent, or Firm*—Michael E. McKee

(57) ABSTRACT

An assembly for controlling the phase relationship between a crankshaft and a camshaft of an internal combustion engine with an outer ring member which is connectable to the crankshaft for receiving rotating torque therefrom and a hub which is connectable to the camshaft for transmitting torque from the outer ring member utilizes at least one elongated, centrifugally-responsive lever member which is pivotally connected to the ring member for pivotal movement relative thereto between radially inwardmost positions and radially outwardmost positions. Moreover, each lever member is connected to the hub so that movement of the lever member between the radially inwardmost and outwardmost positions effects a rotational shift of the hub relative to the outer ring member about the axis of rotation which alters the phase relationship between the crankshaft and the camshaft driven thereby. In addition, leaf spring arrangements are interposed between the outer ring member and the lever members for biasing the lever members from the radially outwardmost position toward the radially inwardmost position in opposition to the centrifugal forces generated by the rotation of the hub about the axis of rotation, and curved beam springs are interposed between the outer ring member and the hub for biasing the hub from one phase relationship relative to the hub toward another phase relationship relative to the hub in opposition to the backdriving torque exerted upon the hub through the camshaft.

21 Claims, 4 Drawing Sheets

ASSEMBLY FOR ALTERING CAMSHAFT TIMING

BACKGROUND OF THE INVENTION

This invention relates generally to camshaft timing in internal combustion engines and relates more specifically to the means and methods used for altering the camshaft timing to improve performance and efficiency of the engine through a broad range of engine speeds.

It is known that by altering the camshaft timing or more specifically, altering the rotational phase relationship between the camshaft and the crankshaft in an internal combustion engine, the timing of the opening and closing of the intake and exhaust valves in relationship to the position of the pistons within the cylinders is altered. By altering this phase relationship and thereby advance or retard the camshaft timing conditions as the speed of the engine is adjusted, the engine performance and efficiency can be improved.

Examples of systems for altering the camshaft timing though a range of engine speeds are described in U.S. Pat. Nos. 4,955,330, 5,181,486 and 5,609,127. Each system of these referenced patents utilizes a rotating assembly which is interposed between the crankshaft and the camshaft for rotating about an axis at a rotational speed which corresponds with the speed of rotation of the engine camshaft. In addition, these rotating assemblies employ internal weights whose positions are adapted to change in response to centrifugal forces generated upon rotation of the assemblies. The amount of adjustment of the phase relationship between the camshaft and the crankshaft is dependent upon the position of the internal weights so that the faster the assembly is rotated, the greater the altering of the camshaft timing.

It is an object of the present invention to provide a new and improved assembly of the aforedescribed class for altering the camshaft timing of an internal combustion engine.

Another object of the present invention is to provide such an assembly for altering the phase relationship between the camshaft and the crankshaft of an internal combustion engine through a broad range of engine speeds.

Still another object of the present invention is to provide such an assembly whose construction and operation improves upon camshaft timing assemblies of the prior art.

Yet another object of the present invention is to provide such an assembly whose working components are compact and well-suited for use in a region adjacent an internal combustion engine where little space may be available.

A further object of the present invention is to provide such an assembly which is uncomplicated in construction and effective in operation.

SUMMARY OF THE INVENTION

This invention resides in an assembly for controlling the phase relationship between a crankshaft and a camshaft of an internal combustion engine.

The assembly includes an outer ring member which is connectable to a crankshaft of an internal combustion engine for receiving rotating torque from the crankshaft and a hub which is connectable to the camshaft of the internal combustion engine for transmitting torque from the outer ring member to the camshaft so that the hub and camshaft rotate with the outer ring member about an axis of rotation. The hub is associated with the outer ring member in a manner which accommodates a rotational shift of the hub relative to the outer ring member about the axis of rotation between a first condition at which the hub is in one phase relationship with the outer ring member and a second condition at which the hub is in another phase relationship with the outer ring member. The assembly also includes at least one centrifugally-responsive lever member which is pivotally connected to the ring member or the hub for pivotal movement of the at least one lever member relative thereto between a first position at which the lever member is disposed in a first positional relationship with respect to the rotation axis and a second position at which the lever member is disposed in a second positional relationship with respect to the rotation axis. In addition, the at least one lever member is connected to the other of the ring member or the hub so that movement of the at least one lever member between the first position and the second position effects a rotational shift of the hub relative to the outer ring member about the axis of rotation between the first condition and the second condition to thereby adjust the phase relationship between the crankshaft and the camshaft rotated thereby. Still further, first biasing means are interposed between the outer ring member and the at least one lever member for biasing the at least one lever member from the second position toward the first position in opposition to the centrifugal forces generated by the rotation of the hub about the axis of rotation.

In one embodiment of the assembly, the first biasing means includes leaf spring means which are adapted to act between the outer ring member and the at least one lever member for biasing the at least one lever member from the second position toward the first position in opposition to the centrifugal forces generated by the rotation of the hub about the axis of rotation.

In a further embodiment of the invention, the assembly includes additional, or a second, biasing means interposed between the outer ring member and the hub for biasing the hub from the second condition toward the first condition in opposition to the torque required to drive the valve train and which is exerted upon the hub through the camshaft. This second biasing means helps to relieve the effects of the valve train torque upon the at least one lever member.

DETAILED DESCRIPTION OF THE ILLUSTRATIVE EMBODIMENT

Figure 1:
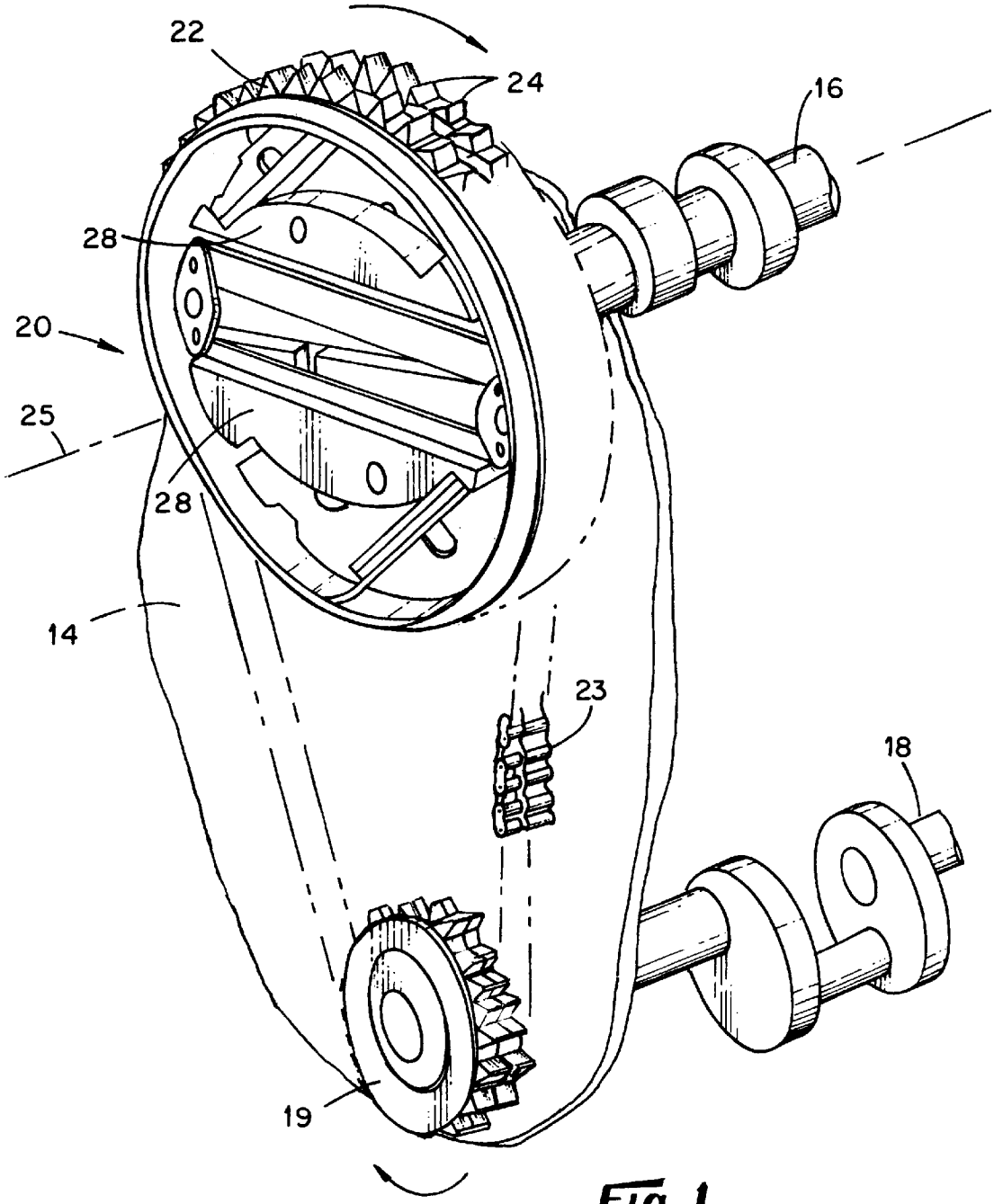
FIG. 1 is a perspective view of an embodiment of an assembly within which features of the present invention are embodied shown operatively attached to an internal combustion engine for use.

Turning now to the drawings in greater detail, there is shown in FIG. 1 an embodiment, generally indicated 20, of an assembly within which features of the present invention are embodied. Within the environment depicted in FIG. 1, the assembly 20 is shown operatively mounted upon an internal combustion engine 14 for use. The assembly 20 is incorporated within the engine components used to drivingly rotate the engine camshaft 16 by way of the engine crankshaft 18. In particular, a toothed sprocket 19 is fixedly attached to an end of the crankshaft 18 at one end of the engine 14, while the assembly 20 is fixedly attached to one end of the camshaft 16 at the same end of the engine 14. The assembly 20 includes an outer ring member 22 which defines outwardly-extending teeth 24 along its outer perimeter, and a timing chain 23 is looped about the teeth of the sprocket 19 and the teeth 24 of the outer ring member 22 so that as the crankshaft 18 is rotated during engine operation, the camshaft 16 is drivingly rotated by the crankshaft 18. The rotation of the camshaft 16, in turn, opens and closes the intake valves and/or the exhaust valves of the engine 14, and the timing of the opening and closing of the valves is coordinated with the position of the pistons within the cylinders of the engine 14.

In conventional internal combustion engines, the camshaft positioning, and hence the timing of the opening and closing of the intake and/or exhaust valves, is normally determined by the position of the camshaft (or more specifically, the camshaft sprocket) relative to a timing mark, which in turn, is determined relative to the piston location as dictated by the rotational position of the crankshaft of the engine. Once in a desired relationship, the sprocket and camshaft are slaved to one another so that the rotation of the sprocket effects the rotation of the camshaft and are driven by the crankshaft and timing chain in a timed relationship. However, although the timing conditions of an engine may be optimum at one speed of the engine, the timing conditions at an alternative speeds may be far from optimum and lead to reduced engine performance and efficiency. Accordingly, the timing of an engine camshaft is normally a compromise of timing conditions over the full range of the engine speed (RPMs).

As will be described herein, the assembly 20 alters the timing conditions of the camshaft 16 in response to a change of speed of the engine 14 so that the performance and efficiency of the engine 14 is enhanced over a broad range of engine speeds. Whether the assembly 20 is used to effect an advance of the camshaft timing or a retardation of the camshaft timing in response to a change in the engine speed will be apparent to one skilled in the art.

Figure 2:
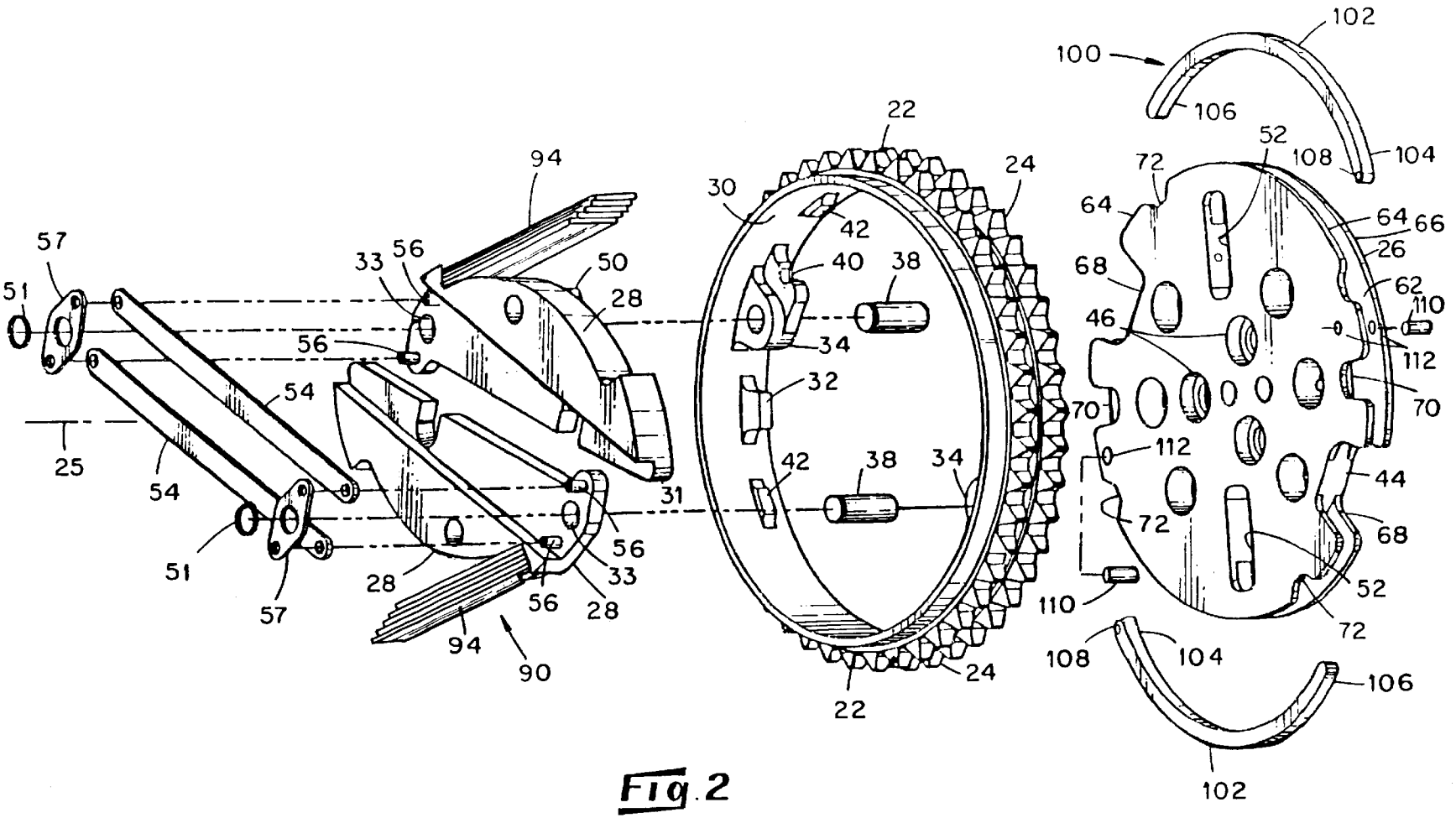
FIG. 2 is an perspective view of the FIG. 1 view of the FIG. 1 embodiment, shown exploded.

With reference to FIG. 2 and in addition to the outer ring member 22, the assembly 20 includes a platen-shaped inner hub 26 positioned within the outer ring member 22. As will be apparent herein, the hub 26 provides the component of the assembly 20 to which the end of the camshaft 16 is fixedly secured, as with bolts, and rotates with the camshaft 16 about an axis 25 of rotation. The outer ring member 22, which is drivingly rotated by the sprocket 19 (FIG. 1) and timing chain 23, rotates with the hub 26 about the rotation axis 25. In addition, centrifugally-responsive lever members, or levers 28, 28, are connected between the outer ring member 22 and the hub 26 for transferring the rotational drive torque from the outer ring member 22 to the hub 26 so that the hub 26, as well as the camshaft 16, is forced to rotate with the outer ring member 22 about the rotation axis 25. Furthermore and as will be apparent herein, the levers 28, 28 are adapted to shift the rotational position of the hub 26 relative to the outer ring member 22 to thereby alter the phase relationship between the ring member 22 and the hub 26.

In the depicted assembly 20, the driving torque of the crankshaft 18 (FIG. 1) is transmitted to the ring member 22 by way of the timing chain 23 and the teeth 24 defined about the periphery of the ring member 22. However, it will be understood that as long as the periphery of the ring member 22 is suitably shaped, the ring member 22 may be drivingly rotated by the crankshaft by way of a gear, drive belt or other cooperating means acting between the crankshaft and the periphery of the ring member 22. Accordingly, the principles of the present invention can be variously applied.

Figure 3:
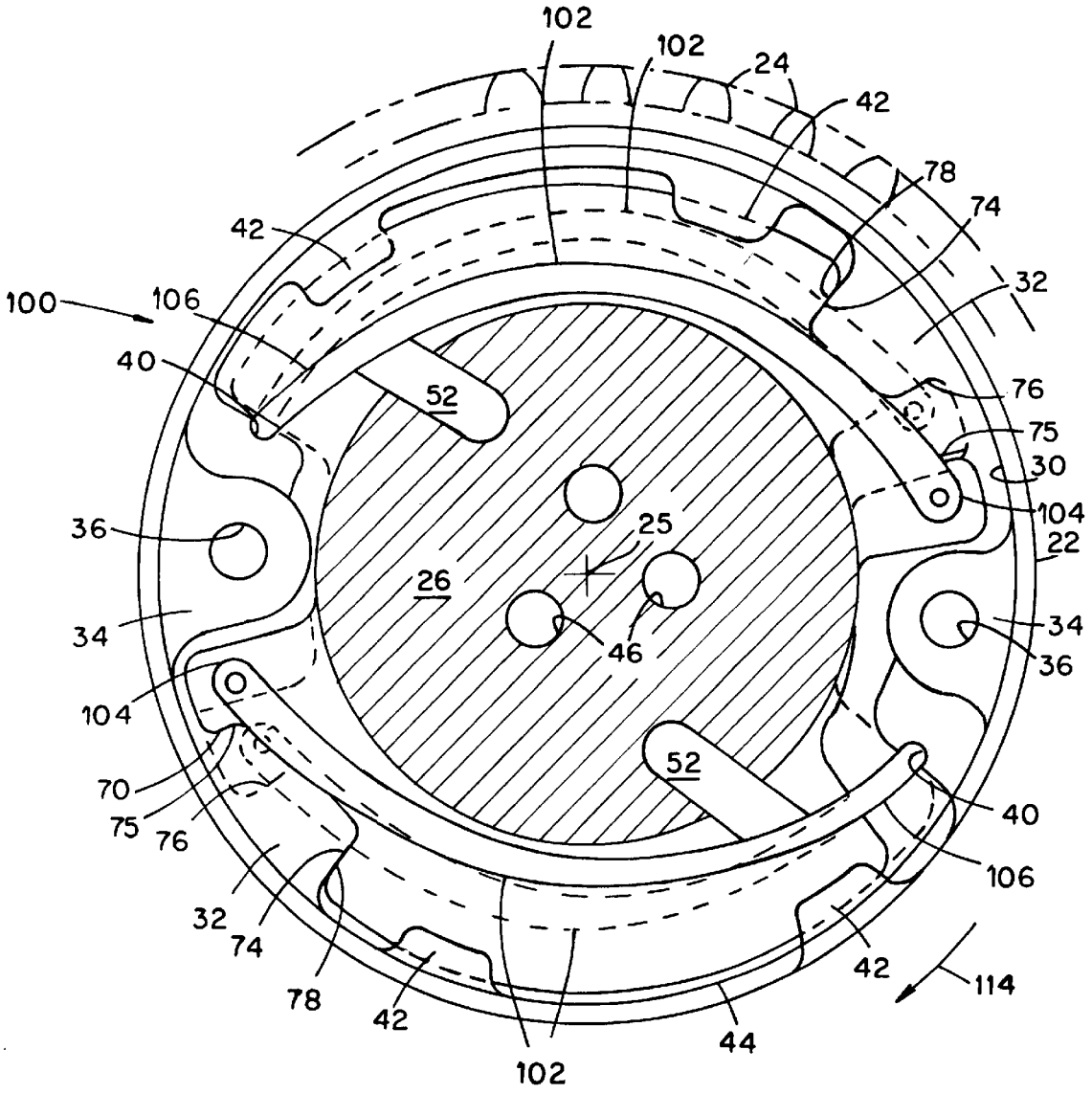
FIG. 3 is a cross sectional view of the FIG. 1 embodiment taken about through the radial midplane of the embodiment.

As best shown in FIGS. 2 and 3, the outer ring member 22 of the depicted assembly 20 is a one-piece unit which includes, in addition to the radially outwardly-directed teeth 24, an annular inner wall 30 along which is provided a pair of tabs 32 which are joined to and are directed radially inwardly of the wall 30 and a pair of additional inwardly-directed bosses 34 by which the levers 28 are connected to the ring member 22. The tabs 32 are diametrically opposed to one another, and each boss 34 includes a bore 36 adapted to accept a pivot pin 38 (FIG. 2) which is arranged so that the longitudinal axis of the pin 38 is parallel to the rotation axis 25. In addition, there is disposed to one side of each boss 34 a body portion which defines a notch 40 whose purpose will become apparent herein, and there are also provided along the inner wall 30 a plurality of (i.e. four) inwardly-directed protuberances 42 adapted to guide the movement of the hub 26 as the hub 26 is shifted (i.e. rotated) in position relative to the ring member 22 about the rotation axis 25.

Figure 4:
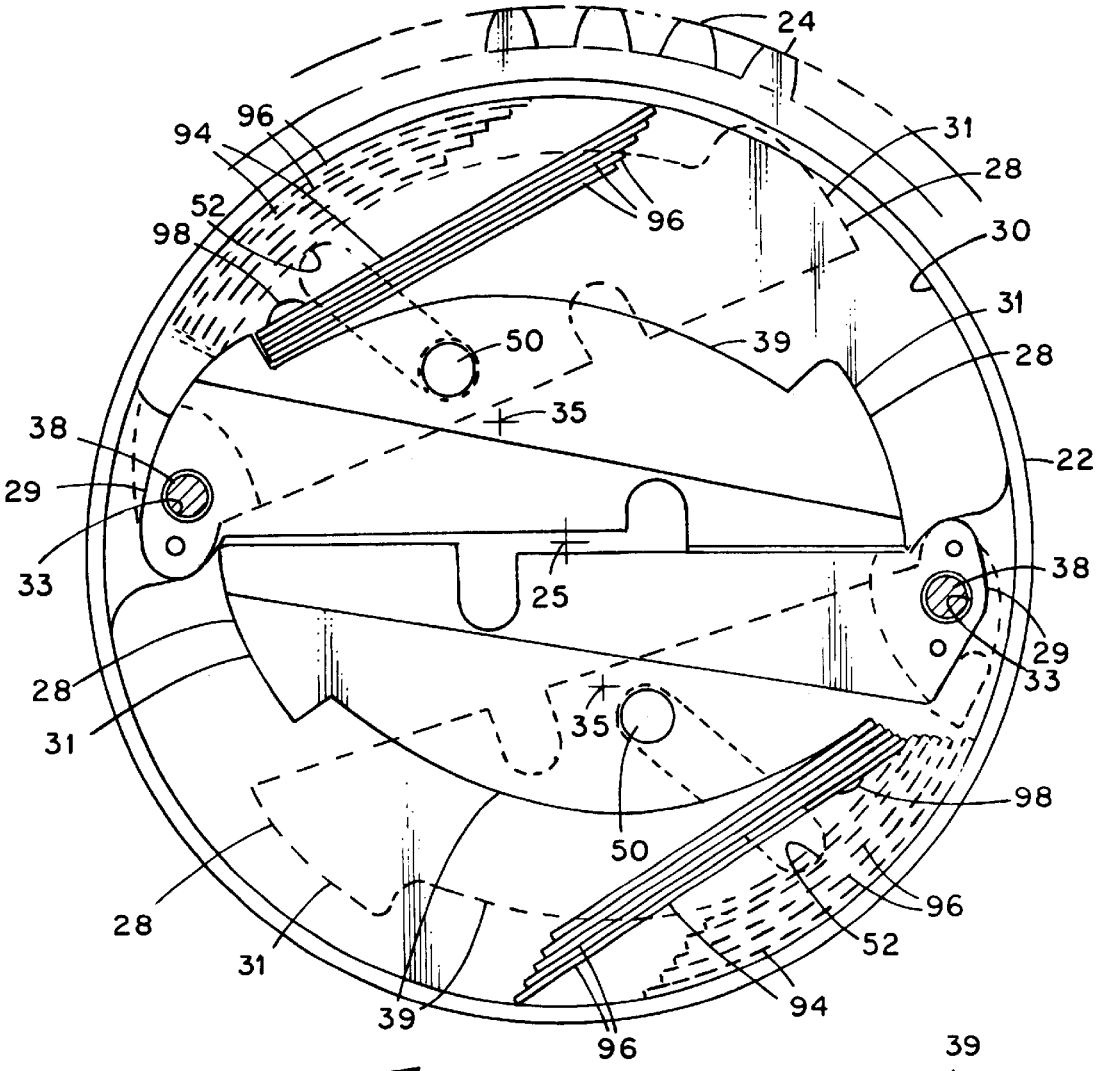
FIG. 4 is a front elevational view of the FIG. 1 embodiment.
Figure 6:
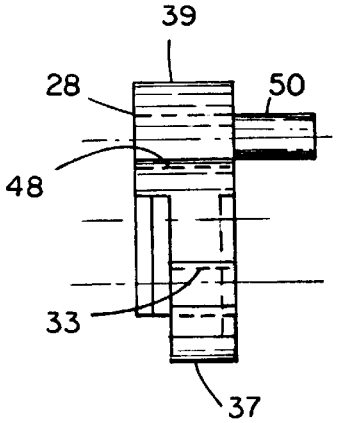
FIG. 6 is an end elevational view of the lever member of FIG. 5 as seen from the right in FIG. 5.
Figure 5:
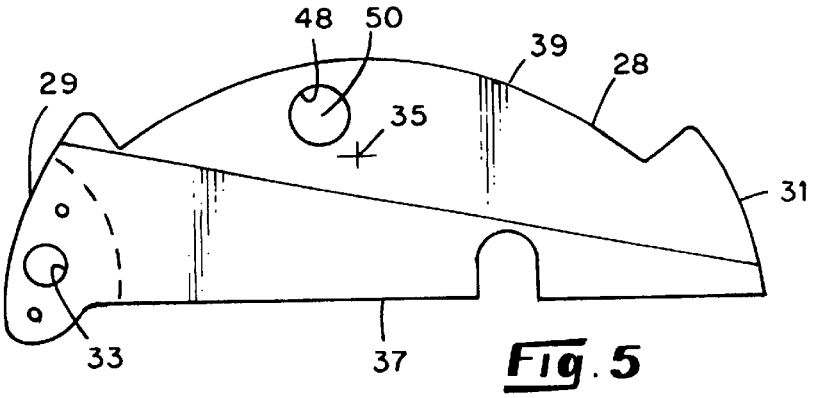
FIG. 5 is a side elevational view of one of the lever members of the FIG. 1 embodiment.

With reference to FIGS. 4–6, each lever 28 is elongated in shape and has two opposite ends 29 and 31, one end 29 of which defines a bore 33. Extending between the ends 29 and 31 of each lever 28 is a linear edge 37 and an arcuate edge 39, as best shown in FIG. 5. In addition, the levers 28 are positioned within the outer ring 22 and are disposed on opposite sides of the rotation axis 25 from one another within the ring 22. Each lever 28 is pivotally connected at one end 29 (by means of the pivot pin 38) to a corresponding boss 34 of the ring member 22 in a manner which permits movement of the levers 28, 28 about the boss 34 between an inwardly-disposed position (as illustrated in solid lines in FIG. 4 and an outwardly-disposed position (as illustrated in phantom in FIG. 4) in response to centrifugal forces generated by the rotation of the hub 26 about the axis 25. In this connection, each pivot pin 38 is secured through the bore 36 (FIG. 3) of the boss 34 and the bore 33 of a corresponding lever 28 with suitable fasteners, such as retainer rings 51 (FIG. 2) which are tightly fitted about the ends of the pins 38. Each lever 28 is constructed of a dense material, such as steel, so that each lever 28 is rendered weighty (i.e. provided with a large mass per unit volume) and has a center of gravity, indicated at 35 in FIGS. 4 and 5 and shown positioned to one side of the bore 33. As the assembly 20 is rotated about the rotation axis 25, centrifugal forces are generated as a result of such rotation. These centrifugal forces urge the levers 38 radially outwardly of the rotation axis 25. More specifically and since the lever ends 29 are pinned to the bosses 34 (adjacent the periphery of the ring member 22), the opposite ends 31 of the levers 38 tend to pivot radially outwardly about the pins 38 from the FIG. 4 solid-line position toward the FIG. 4 phantom-line position under the influence of the generated centrifugal forces.

For purposes of connecting the levers 28 to the hub 26, each lever 28 is provided with a through-bore 48 (FIG. 5) disposed about midway between the ends 29, 31 of the lever 28, and a pin 50 is force-fitted within the through-bore 48 so that the longitudinal axis of the pin 50 is arranged parallel to the longitudinal axis of the pivot pin 38 and one end of the pin 50 protrudes to one side of the lever 28 as shown in FIG. 6. As will be apparent herein, the protruding end of the pin 50 is slidably accepted by a slot defined within the hub 26 so that movement of the lever 28 between the FIG. 4 solid-line and phantom-line positions rotates the hub 26 relative to the outer ring member 22 about the rotation axis 25 as the pin 50 is guided along the length of the slot and thereby alters the phase relationship between the hub 26 and the ring member 22.

In the depicted assembly 20 and with reference again to FIG. 2, the levers 28 are connected to one another by way of a pair of linkages 54 so that pivotal movement of one lever 28 (i.e. between the FIG. 4 solid-line and phantom-line positions) effects the movement of the other linkage 28 between its FIG. 4 solid-line and phantom-line positions by a corresponding amount. To this end, there is provided a pair of pins 56 which are formed within the body of the levers 28 adjacent the end 29 thereof and on opposite sides of the lever bore 33, and a pair of links 57 (having openings at the opposite ends thereof) are secured about these pins 56 with a fastener (e.g. the retaining ring 51) used to secure the pivot pin 38 in place so that the linkages 54 are secured between the links 57 and the corresponding surfaces of the levers 28. Therefore and as centrifugal forces urge the levers 28 to move radially inwardly or outwardly of the ring member 22 with respect to the rotation axis 25, the linkages 54 ensure that the motion of the levers 28 is synchronized thus making for a more robust design than would be the case if the levers 28 were not synchronized. While the linkages 54 are relatively small and thus carry low buckling loads, two linkages 54 are used in the depicted assembly 20 to ensure that at any point in time during use, one of the linkages 54 is in tension.

With reference again to FIGS. 2 and 3, the hub 26 is a one-piece unit having a body 44 which is substantially planar in form and includes a plurality of openings 46 which facilitate the attachment of the hub 26 to the end of the camshaft 18. To this end, the openings 46 accept the shanks of bolts inserted therethrough and threaded into internally-threaded openings provided in the end of the camshaft 18 (or, more specifically, into internally-threaded openings provided in a camshaft button which, in turn, has been fixedly secured about the end of the camshaft 18) so that the hub 26 is thereby fixedly secured to the end of the camshaft 18 and is forced to rotate with the camshaft 18 about the rotation axis 25. It will be understood that the hub 26 is attached to the camshaft 18 so that the plane of its body 44 is substantially normal to the axis 25.

In addition, the hub body 44 defines a pair of slots 52 therein which extend generally radially outwardly of the rotation axis 25, and it is these slots 52 which accept the protruding ends of the pins 50 for cooperatively connecting the levers 28 to the hub 26 so that movement of the levers 28 between the FIG. 4 solid-line and phantom-line positions effects a change in the phase relationship between the outer ring member 22 and the hub 26. In the depicted assembly 20, the slots 52 are canted with respect to an imaginary line drawn radially across the hub 26 between the slot 52 and the rotation axis 25 so that when the levers 28 are in the FIG. 4 phantom-line position, the hub 26, and hence the camshaft 16, lags a predetermined number of degrees behind the condition of the hub 26 when the levers 28 are in the FIG. 4 solid-line position. In the depicted assembly 20, the hub 26 of the FIG. 4 phantom position lags four degrees behind the hub 26 of the FIG. 4 solid-line position, but alternative magnitudes of the lag can be designed into the assembly. Consequently, the levers 28 and hub 26 of the depicted assembly 20 act as cam and cam follower to rotate, or shift, the hub 26 in one rotational direction or the opposite rotational direction relative to the hub 26 as the pins 50 are forced to slide along the slots 52 in response to a shift of the levers 28 between the FIG. 4 solid-line and phantom-line positions and permit up to, for example, a four degree change in the phase relationship between the hub 26 and the outer ring member 22. Moreover, the angle (i.e. geometry) of the slots 52 has been selected so that when the levers 28 are positioned in the FIG. 4 solid-line position, friction which acts between the surface of the slots 52 and the pins 50 prevent the levers 28 from being back-driveable. In other words, the geometric relation between each slot 52 and the corresponding pin 50 is such that when the lever members 28 are disposed in the positional relationship depicted in solid lines in FIG. 4, the lever members 28 are prevented from moving toward the FIG. 4 phantom-line by torque which may be applied to the lever members from the camshaft. This way, the phase relationship between the crankshaft and the camshaft is fixed at low engine speeds (e.g. through the engine speed range normally experienced at start up).

Furthermore and with reference again to FIG. 2, the hub 26 includes a periphery 60 which is sized to be accepted by the interior of the ring member 22, and an annular groove 62 is defined around the periphery 60 which provides the hub 26 with a pair of outwardly-extending lips 64 and 66. Collectively these lips 64, 66 define large diametrically-opposed notches 68 adapted to accept the bosses 38 when the hub 26 is inserted sidewise into the ring member 22 upon assembly. Similarly, the lip 64 defines a pair of diametrically-opposed notches 70 for accepting the tabs 32 and a plurality of notches 72 (e.g. four) for accepting the protuberances 42 when the hub 26 is inserted sidewise into the ring assembly 22 upon assembly. When the hub 26 is positioned within the interior of the ring member 22, the lips 64 and 66 are situated on opposite sides of the protuberances 42 so that the lips 64 and 66 confine the movement of the hub 26 within the plane of the ring member 22. Therefore and as mentioned earlier, the protuberances 42 and lips 64, 66 cooperate with one another to guide the movement of the hub 26 along the inner wall 30 of the ring member 22 during a change in the phase relationship between the ring member 22 and the hub 26.

Although the rotation of the hub 26 relative to the ring member 22 can be limited by the cooperation between any of a number of components of the assembly 20, the rotation of the hub 26 relative to the ring member 22 is limited in the depicted assembly 20 by the cooperation between the levers 28 and other components of the assembly 20. More specifically, at one rotational limit of the hub 26 relative to the outer ring member 22 (i.e. when the hub 26 is in the FIG. 4 solid-line position), the surfaces of the levers 28 abuttingly engage one another, and at the other rotational limit of the hub 26 relative to the outer ring member 22 (i.e. when the hub 26 is in the FIG. 4 phantom-line position), the ends 31 of the levers 28 abuttingly engage the inner wall 30 of the outer ring member 22. Therefore, the range of the permitted rotational shift of the hub 26 relative to the outer ring member 22 about the rotation axis 25 within the depicted assembly 20 is determined by the range of the permitted movement of the levers 28 within the assembly 20.

It is a feature of the assembly 20 that it includes a first biasing means, indicated 90 in FIGS. 1 and 2, for continually biasing the levers 28 radially inwardly toward the rotation axis 25 from the FIG. 4 phantom-line position toward the FIG. 4 solid-line position (i.e. from the radially outwardmost position of the levers 28 toward the radially inwardmost position of the levers 28). To this end, the first biasing means 90 includes leaf spring means in the form of a cantilever-type leaf spring arrangement 94 comprising a plurality of elongated, planar leaf springs 96 which are joined together at one end and suitably fastened, as with a screw 98, to the arcuate (i.e. outwardmost) edge 39 of the body of the lever 28 so that when the assembly 20 is assembled, the spring arrangement 94 is disposed between the inner wall 30 of the ring member 22 and the arcuate edge 39 of the lever body. In addition and as best shown in FIG. 4, the end of the spring arrangement 94 opposite the screw 98 is in constant contact with the inner wall 30 of the ring member 22 as the lever 28 is moved between the FIG. 4 solid-line and phantom-line positions (i.e. the radially inwardmost and radially outwardmost positions) so that the corresponding lever 28 is continually biased toward the rotation axis 25. Moreover, these cantilever-type springs 96 of the arrangement 94 are adapted to resiliently flex along the length thereof from a condition as illustrated in solid lines in FIG. 4 at which the springs 96 are in a slightly flexed (i.e. slightly arcuate) condition to the condition as illustrated in phantom in FIG. 4 at which the springs 96 are in a more flexed condition disposed adjacent the inner wall 30.

The leaf spring arrangement 94 is advantageous in that it provides a relatively strong biasing force for the (relatively small amount of) space occupied by the spring arrangement 94. In contrast, helical coil springs—which normally define open spaces along the center of the coils—use space more inefficiently than do the leaf springs 96 because the leaf springs 96 have no comparable open space. Furthermore, the stresses to which the spring arrangement 94 are exposed are relatively constant throughout the length of the spring arrangement 94 because as the levers 28 are moved between the FIG. 4 solid-line and phantom-line positions, the arrangement 94 is flexed, or bent, along the length thereof in a manner which wraps the arrangement 94 about the arcuate edge 39 of the lever 28 on a relatively constant radius. Along the same lines, when each spring arrangement 94 is flexed to its condition as illustrated in phantom in FIG. 4, the shape of the arrangement 94 conforms generally with the arcuate shape of the arcuate edge 39 of the lever 28. Moreover and because the surfaces of the leaf springs 96 are free to slide along one another as the arrangement 94 is flexed during use, the leaf springs 96 act independent of one another and the spring arrangement 94 is exposed to a much smaller amount of bending stress for a given amount of deflection than would normally be the case if the spring arrangement were comprised of a single spring whose thickness corresponds with that of the spring arrangement 94. Thus, the provision of the several thin leaf springs 96 reduces the stress within the individual springs 96 while still providing the necessary spring rate.

Furthermore, the design of each lever 28 (with its arcuate edge 39) is such that the maximum stress induced within each spring arrangement 94 is limited to a maximum stress which is dependent upon the radius of the arcuate edge 39 and the thickness of each individual leaf spring 96. Such a feature is advantageous in that the spring arrangement 94 can circumvent the detrimental effects of cyclical or fluctuating stresses that can fatigue helical springs and ultimately lead to spring failure.

Further still, the location of the point at which each spring arrangement 94 is anchored to its corresponding lever 28 (i.e. with the screw 98) has been selected to induce the maximum amount of torque about the pivot axis of the lever 28 and for yielding the maximum centrifugal torque of the lever 28 while leaving sufficient space for the various internal components of the assembly 20.

The spring material found suitable for use as the leaf spring 96 in the spring arrangement 94 is steel shim or feeler gauge stock having a thickness of about 0.20 inches in thickness, and the number of leaf springs 96 utilized in the stacked arrangement 94 of springs is nine, although the number of leaf springs 96 used in alternative assemblies can vary. Because the operation of each spring 96 simulates that of a cantilever beam, the deflection characteristics of the spring 96 can be mathematically predicted. If a spring arrangement having different characteristics from those of the spring arrangement 94 are desired, a stacked relationship of leaf springs of different thickness and/or number of springs can be employed. Thus, the length (or lengths) and number of the leaf springs 96 can be modified to tune or alter the operation of the assembly 20.

It follows that the biasing forces of the spring arrangements 94 upon the levers 28 oppose the centrifugal forces generated within the assembly 20 during rotation about the rotation axis 25. Consequently, when the assembly 30 is not rotating and thus no centrifugal forces are generated within the assembly 20, the levers 28 are maintained in the inwardmost, or FIG. 4 solid-line, position.

As the rotational speed of the assembly 20 is increased, the centrifugal forces generated within the assembly 20 increase as well so that the levers 28 begin to pivot about the pivot pins 38 outwardly toward the FIG. 4 phantom-line position. The outward movement of the levers 28 halt when an equilibrium (between the centrifugal forces and the biasing forces of the spring arrangements 94) is reached or if the hub 26 reaches its FIG. 3 phantom-line condition at which the ends 31 of the levers 28 move into abutting relationship with the inner surface 30 of the outer ring member 22. As the rotational speed of the assembly 20 is subsequently decreased so that the centrifugal forces are relaxed, the spring arrangements 94 compel the levers 28 to return inwardly toward the FIG. 4 solid-line position. It will be understood, therefore, that the movement of the levers 28 is continuous as they move between the FIG. 4 solid-line and phantom-line positions so that at no time is the motion of the levers 28 discontinuous or discreet in nature.

With reference again to FIGS. 2 and 3, the assembly 20 also includes second biasing means 100 for biasing the hub 26 relative to the outer ring 22 toward the FIG. 3 solid-line condition (at which the hub 26 and ring 22 are in an initial phase relationship with one another) from the FIG. 3 phantom-line condition (at which the hub 26 lags the ring 22 by about four rotational degrees from the initial, solid-line phase relationship). The purpose served by the second biasing means 100 is that it helps to counter some of the backdriving torque exerted upon the hub 26 by the engine valve train through the camshaft 16. In other words, the biasing means 100 act to carry in some proportion the torque required to drive the camshaft 16 that can, in turn, lessen, remove or even reverse the forces acting on the levers 28. In the depicted application of the assembly 20, the backdriving torque is the portion of the torque required to drive the valve train that the levers 28 must transmit to the hub 26 in order for the hub 26 to rotate at all, and this torque requirement can influence the operating motion of the levers 28. Without the second biasing means 100, all of the torque required to drive the valve train must be transmitted by the levers 28. Consequently, the second biasing means 100 can reduce, remove or reverse the backdriving torque.

In the depicted assembly 20, the second biasing means 100 includes a pair of elongated, arcuate-shaped balancing springs 102 which are constructed, for example, of steel and which are disposed within the annular groove 62 (FIG. 2) and on diametrically opposite sides of the rotation axis 25. With reference to FIGS. 2 and 3, each of these balancing springs 102 includes two opposite ends 104, 106, and one spring end 104 defines a through-bore 108. The spring end 104 is pinned to the hub 26 with a pin 110 which extends through the through-bore 108 and aligned openings 112 formed in the lips 64, 66 of the hub 26. The opposite end 106 of each spring 102 is positioned in abutting relationship with the notch 40 formed in a corresponding boss 34 of the outer ring member 22.

The depicted assembly 20 is forced to rotate about the rotation axis 25 in the direction of the FIG. 3 arrow 114. To enable the balancing springs 102 to counter at least some of the valve train (or camshaft) torque, each spring 102 is adapted to flex between its ends 104, 106 from the lengthened condition illustrated in solid lines in FIG. 3 to the shortened condition illustrated in phantom lines in FIG. 3 as the opposite ends of each spring 102 act between the hub 26 (by way of the pin 110) and the outer ring member (by way of the boss 34). Consequently, each spring 102 is in the form of a curved beam which, when compressed between its ends toward the shortened FIG. 3 phantom-line condition, seeks to return (under the influence of its resilient nature) to its lengthened condition so that the hub 26 is continually biased relative to the outer ring member 22 toward the hub/ring member phase relationship depicted in solid lines in FIG. 3. When the assembly 20 is assembled, the springs 102 are preferably exposed to at least a small degree of compression when in the FIG. 3 solid-line condition so that by virtue of the fact that the springs 102 are always in compression, the cyclical or fatigue life of the springs 102 is increased.

The balancing springs 102 of the second biasing means 100 are advantageous for a number of reasons. Firstly, the springs 102 can be readily replaced with similarly-shaped springs having a different spring rate to alter or tune the performance of the assembly 20. Furthermore, the curved beam form of the springs 102 is such that the energy density of the springs 102 can be maximized. By comparison, helical springs normally define open spaces along the centers of the coils of the springs, and such open spaces do not exist in the springs 102 because the springs 102 are solid in cross section. Thus, the springs 102 permit the hub 26 to be more solidly designed (meaning less machining) while not requiring space that could otherwise be occupied by the levers 28. Further still, the springs 102 are internal to the assembly 20 and are thus protected and constrained as an internal component of the assembly 20.

It follows that during rotation of the assembly 20 about the rotation axis 25, the springs 102 of the second biasing means 100 continually bias the hub 26 relative to the outer ring member 22 in the direction of rotation of the assembly 20 and are capable of resiliently flexing between the ends thereof in response to the valve train torque exerted thereon by the camshaft 18 and the attending valve train. Preferably, the biasing torque created by the balancing springs 102 is equal and opposite the torque required to drive the camshaft and valve train at all engine speeds so that the backdriving torque is zero and so that the torque required to drive the valve train has no appreciable effect upon the operation of the levers 28 at any engine speed. As a practical matter, however, this is normally not possible. However, one solution, or approach, is to size the balancing springs 102 so that the biasing torque of the balancing springs 102 is equal and opposite the valve train (or camshaft) torque at full deflection. In any event, the balancing springs 102 of the biasing means 100 counteract, or offset, a significant amount of the valve train torque to thereby reduce the affect of the valve train torque upon the levers 28 and are advantageous in this respect.

It will be understood that numerous modifications and substitutions can be had to the aforedescribed embodiment without departing from the spirit of the invention. For example, although the levers 28 of the assembly 20 has been shown and described as being pivotally connected to the outer ring member 22 and cooperating with slots 52 provided in the hub 26 for altering the phase relationship between the hub 26 and the ring member 22, an assembly can be similarly designed and constructed wherein the lever members are pivotally attached to the hub so that the lever members cooperate with slots formed in a segment of the outer ring member to alter the phase relationship between the hub and the outer ring member.

Moreover, although the hub 26 of the depicted assembly 20 has been shown and described as being formed as a single unit, the hub 26 may be formed in multiple parts which are subsequently joined together. For example, one of the lips 64 of the hub 26 can be formed as a unit separate from the remainder of the hub body and subsequently joined to the remainder of the hub body with screws.

Furthermore, although the assembly 20 has been shown and described as including two levers 28 which are diametrically disposed on opposite sides of the rotation axis 25 from one another for cooperating with the hub 26 to alter the phase relationship between the hub 26 and the outer ring member 22, an assembly in accordance with the broader aspects of this invention can include an alternative number of levers or even a single lever for this purpose. For balancing considerations, however, it is preferable that the number of levers employed in an assembly number at least two and that the levers (when numbering at least two) are regularly spaced about the rotation axis.

Further still, although each leaf spring arrangement 94 has been shown and described above as being attached (as with a screw 98) at one end to the body of a lever 28 so that its other end acts against the inner wall 30 of the outer ring member 22, an assembly in accordance with the present invention can include a leaf spring arrangement which is attached at one end to the outer ring member 22 so that its other end acts against the body of the lever 28.

Still further, although the slots 52 of the depicted assembly 20 are substantially linear in shape, the slots can be non-linear in form to tune or alter the operation of the device. Accordingly, the aforedescribed embodiment 20 is intended for the purpose of illustration and not as limitation.

What is claimed is:

1. A centrifugally-actuated assembly for controlling the phase relationship between the crankshaft and at least one camshaft of an internal combustion engine, the assembly comprising:

an outer ring member which is connectable to the crankshaft of an internal combustion engine for receiving rotating torque from the crankshaft;

a hub which is connectable to at least one camshaft of the internal combustion engine for transmitting torque from the outer ring member to the camshaft so that the hub and camshaft rotate with the outer ring member about an axis of rotation, the hub being associated with the outer ring member in a manner which accommodates a rotational shift of the hub relative to the outer ring member about the axis of rotation between a first condition at which the hub is in one phase relationship with the outer ring member and a second condition at which the hub is in another phase relationship with the outer ring member, and the hub and outer ring member cooperate with one another so that a rotational shift of the hub relative to the outer ring member is guided along a predetermined path within the outer ring member;

at least two centrifugally-responsive lever members wherein each lever member is pivotally connected to the outer ring member for pivotal movement of the lever member relative to the ring member between a first position at which the lever member is disposed in a first positional relationship with respect to the rotation axis and a second position at which the lever member is disposed in a second positional relationship with respect to the rotation axis, and each lever member is connected to the hub so that movement of the lever member between the first position and the second position effects a rotational shift of the hub relative to the outer ring member about the axis of rotation between the first condition and the second condition to thereby adjust the phase relationship between the crankshaft and the camshaft driven thereby;

first biasing means interposed between the outer ring member and the lever members for biasing the lever members from the second position toward the first position in opposition to the centrifugal forces generated by the rotation of the hub about the axis of rotation wherein the biasing means includes leaf spring means which are adapted to act between the outer ring member and at least one lever member for biasing the at least one lever member from the second position toward the first position in opposition to the centrifugal forces generated by the rotation of the hub about the axis of rotation; and a second biasing means interposed between the outer ring member and the hub for biasing the hub from the second condition toward the first condition in opposition to the valve train torque exerted upon the hub through the camshaft, wherein the second biasing means includes at least one resilient spring which is interposed between the hub and the outer ring for continually biasing the hub from the second condition toward the first condition in opposition to the valve train torque exerted upon the hub through the camshaft.

2. The assembly as defined in claim 1 wherein each lever member includes a pin, and the hub has a body defining a slot therein, and the pin of the lever member is slidably accepted by the slot so that as the lever member is moved between its first and second position, the hub is moved between its first and second conditions as the pin of the lever member is guided along the slot.

3. The assembly as defined in claim 2 wherein the geometric relation between the slot and the pin is such that when the lever members are disposed in the first positional relationship, the levers are prevented from moving toward the second positional relationship by torque which may be applied to the lever members from the camshaft.

4. An assembly for controlling the phase relationship between a crankshaft and a camshaft of an internal combustion engine, the assembly comprising:

an outer ring member which is connectable to a crankshaft of an internal combustion engine for receiving rotating torque from the crankshaft;

a hub which is connectable to the camshaft of the internal combustion engine for transmitting torque from the outer ring member to the camshaft for rotating the camshaft and hub with the outer ring member about an axis of rotation, the hub being associated with the outer ring member in a manner which accommodates a rotational shift of the hub relative to the outer ring member about the axis of rotation between a first condition at which the hub is in one phase relationship with the outer ring member and a second condition at which the hub is in another phase relationship with the outer ring member;

at least one centrifugally-responsive lever member which is pivotally connected to one of the ring member and the hub for pivotal movement relative thereto between a first position at which the at least one lever member is disposed in a first positional relationship with respect to the rotation axis and a second position at which the at least one lever member is disposed in a second positional relationship with respect to the rotation axis, and the at least one lever member is connected to the other of the ring member and the hub so that movement of the at least one lever member between the first position and the second position effects a rotational shift of the hub relative to the outer ring member about the axis of rotation between the first condition and the second condition to thereby adjust the phase relationship between the crankshaft and the camshaft driven thereby;

a first biasing means interposed between the outer ring member and the at least one lever member for biasing the at least one lever member from the second position toward the first position in opposition to the centrifugal forces generated by the rotation of the hub about the axis of rotation; and a second biasing means interposed between the outer ring member and the hub for biasing the hub from the second condition toward the first condition in opposition to the valve train torque exerted upon the hub through the camshaft.

5. The assembly as defined in claim 4 wherein the second biasing means includes at least one resilient spring which is interposed between the hub and the outer ring for continually biasing the hub from the second condition toward the first condition in opposition to the valve train torque exerted upon the hub through the camshaft.

6. The assembly as defined in claim 5 wherein the resilient spring of the second biasing means is a curved beam spring having two opposite ends, and each of the opposite ends of the curved beam spring acts between a corresponding one of the hub and the outer ring member for biasing the hub from the second condition toward the first condition and is adapted to resiliently flex between its ends as the hub and outer ring member are moved relative to one another between the first and second conditions.

7. The assembly as defined in claim 4 wherein the first biasing means includes leaf spring means for biasing the lever members from the second position toward the first position in opposition to the centrifugal forces generated by the rotation of the hub about the axis of rotation.

8. The assembly as defined in claim 7 wherein the leaf spring means includes at least one leaf spring arrangement wherein the at least one leaf spring arrangement is adapted to act as a cantilever spring between the outer ring member and a corresponding lever member for biasing the at least one lever member from the second position toward the first position in opposition to the centrifugal forces generated by the rotation of the hub about the axis of rotation.

9. The assembly as defined in claim 8 wherein the at least one leaf spring arrangement includes a plurality of elongated leaf springs arranged in a stacked relationship so that as the lever members are moved between the first and second positions, the leaf springs flex independently of one another.

10. The assembly as defined in claim 9 wherein one end of each leaf spring in the at least one leaf spring arrangement is secured to a corresponding lever member and the opposite end of each leaf spring of the at least one leaf spring arrangement is urged against the outer ring member as the at least one lever member is moved between the first and second positions.

11. The assembly as defined in claim 9 wherein the outer ring has an inner wall which is directed radially inwardly of the assembly, the at least one leaf spring arrangement is elongated in shape with two opposite ends wherein one end of the at least one leaf spring arrangement is positioned in engagement with the at least one lever member and the other end of the at least one leaf spring arrangement is positioned in engagement with the inner wall, and the at least one leaf spring arrangement is adapted to resiliently flex between its opposite ends as the at least one lever member is moved between the first and second positions.

12. The assembly as defined in claim 4 wherein the ring member has a periphery, the at least one lever member has two opposite ends, and the at least one lever member is pivotally connected at one of its ends to the ring member at a location thereon adjacent the periphery thereof for pivotal movement of the at least one lever member relative to the ring member about said location between the first and second positions.

13. An assembly for controlling the phase relationship between a crankshaft and a camshaft of an internal combustion engine, the assembly comprising:

an outer ring member which is connectable to a crankshaft of an internal combustion engine for receiving rotating torque from the crankshaft;

a hub which is connectable to the camshaft of the internal combustion engine for transmitting torque from the outer ring member to the camshaft so that the hub and camshaft rotate with the outer ring member about an axis of rotation, the hub being associated with the outer ring member in a manner which accommodates a rotational shift of the hub relative to the outer ring member about the axis of rotation between a first condition at which the hub is in one phase relationship with the outer ring member and a second condition at which the hub is in another phase relationship with the outer ring member;

at least one centrifugally-responsive lever member which is pivotally connected to one of the ring member and the hub for pivotal movement of the lever member relative thereto between a first position at which the lever member is disposed in a first positional relationship with respect to the rotation axis and a second position at which the lever member is disposed in a second positional relationship with respect to the rotation axis, and the at least one lever member is connected to the other of the ring member and the hub so that movement of the at least one lever member between the first position and the second position effects a rotational shift of the hub relative to the outer ring member about the axis of rotation between the first condition and the second condition to thereby adjust the phase relationship between the crankshaft and the camshaft driven thereby;

first biasing means interposed between the outer ring member and the at least one lever member for biasing the at least one lever member from the second position toward the first position in opposition to the centrifugal forces generated by the rotation of the hub about the axis of rotation wherein the first biasing means includes leaf spring means which are adapted to act between the outer ring member and the at least one lever member for biasing the at least one lever member from the second position toward the first position in opposition to the centrifugal forces generated by the rotation of the hub about the axis of rotation; and second biasing means interposed between the outer ring member and the hub for biasing the hub from the second condition toward the first condition in opposition to the valve train torque exerted upon the hub through the camshaft.

14. The assembly as defined in claim 13 wherein the leaf spring means includes at least one leaf spring arrangement wherein the at least one leaf spring arrangement is adapted to act as a cantilever spring between the outer ring member and the at least one lever member for biasing the at least one lever member from the second position toward the first position in opposition to the centrifugal forces generated by the rotation of the hub about the axis of rotation.

15. The assembly as defined in claim 14 wherein the at least one leaf spring arrangement includes a plurality of elongated leaf springs arranged in a stacked relationship so that as the at least one lever member is moved between the first and second positions, the leaf springs flex independently of one another.

16. The assembly as defined in claim 15 wherein one end of each leaf spring in the at least one leaf spring arrangement is secured to the at least one lever member and the opposite end of each leaf spring of the leaf spring arrangement is urged against the outer ring member as the at least one lever member is moved between the first and second positions.

17. The assembly as defined in claim 14 wherein the outer ring has an inner wall which is directed radially inwardly of the assembly, the at least one leaf spring arrangement is elongated in shape with two opposite ends wherein one end of the leaf spring arrangement is positioned in engagement with the at least one lever member and the other end of the at least one leaf spring arrangement is positioned in engagement with the inner wall, and the at least one leaf spring arrangement is adapted to resiliently flex between its opposite ends as the at least one lever member is moved between the first and second positions.

18. The assembly as defined in claim 13 wherein the second biasing means includes at least one resilient spring which is interposed between the hub and the outer ring for continually biasing the hub from the second condition toward the first condition in opposition to the valve train torque exerted upon the hub through the camshaft.

19. The assembly as defined in claim 18 wherein the at least one resilient spring of the second biasing means is a curved beam spring having two opposite ends, and each of the opposite ends of the curved beams spring acts between a corresponding one of the hub and the outer ring member for biasing the hub from the second condition toward the first condition and is adapted to resiliently flex between its ends as the hub and outer ring member are moved relative to one another between the first and second conditions.

20. The assembly as defined in claim 13 including a plurality of centrifugally-responsive lever members which are regularly spaced about the rotation axis and which are each pivotally connected to the ring member or the hub for pivotal movement relative thereto between the first and second positions, each lever member is connected to the other of the ring member or the hub so that movement of the lever members between the first position and the second position effects a rotational shift of the hub relative to the outer ring member about the axis of rotation between the first condition and the second condition to thereby adjust the phase relationship between the crankshaft and the camshaft driven thereby, and the leaf spring means includes a leaf spring arrangement disposed between the outer ring member and a corresponding lever member for biasing the corresponding lever member from the second position toward the first position in opposition to the centrifugal forces generated by the rotation of the hub about the axis of rotation.

21. The assembly as defined in claim 20 wherein the lever members are coupled together so that movement of the lever members between the first and second positions is synchronized.

* * * * *